United States Patent [19]

Smith

[11] Patent Number: 4,934,557

[45] Date of Patent: Jun. 19, 1990

[54] TAMPER EVIDENT CLOSURE AND CONTAINER

[75] Inventor: Ernest L. Smith, Kansas City, Mo.

[73] Assignee: Sealright Company, Inc., Kansas City, Mo.

[21] Appl. No.: 279,930

[22] Filed: Dec. 5, 1988

[51] Int. Cl.[5] ..... B65D 17/40

[52] U.S. Cl. ..... 220/276; 220/307

[58] Field of Search ..... 220/266, 270, 276, 306, 220/307; 215/253, 254, 255, 256

[56] References Cited

U.S. PATENT DOCUMENTS

| | | | |
|---|---|---|---|
| 4,113,136 | 9/1978 | Abbott | 220/276 |
| 4,465,205 | 8/1984 | Sutch | 220/276 |
| 4,476,993 | 10/1984 | Krout | 220/276 |
| 4,487,329 | 12/1984 | Winstead | 220/276 |
| 4,488,658 | 12/1984 | Smith et al. | 220/276 |
| 4,493,432 | 1/1985 | Smith | 220/270 |
| 4,643,329 | 2/1987 | Mobberley et al. | 220/257 |
| 4,718,571 | 1/1988 | Bordner | 220/270 |
| 4,721,210 | 1/1988 | Lawrence et al. | 215/254 X |
| 4,735,337 | 4/1988 | Von Holdt | 220/276 |
| 4,836,407 | 6/1989 | Bruce et al. | 220/276 |

*Primary Examiner*—Stephen P. Garbe
*Assistant Examiner*—Nova Stucker

[57] ABSTRACT

A tamper evident food package comprising a container and a removable closure. A plurality of locking members are provided on the closure and engage a downturned lip of the container to prevent removal of the closure while in place. The locking members form part of a detachable tear strip which may be detached to permit removal of the closure. Detachment of the tear strip provides visual indication of unauthorized opening of the food package.

22 Claims, 1 Drawing Sheet

TAMPER EVIDENT CLOSURE AND CONTAINER

BACKGROUND OF THE INVENTION

This invention relates in general to the packaging of foods and more particularly to a food container and closure which provides a visual indication when the closure has been removed so that unauthorized opening of the container may be detected.

Cottage cheese, sour cream, yogurt and other dairy products are normally packaged in relatively inexpensive containers formed from injection molded plastic or coated paperboard. The containers include reusable lids which tightly engage the upper rim of the container sidewall to seal the container contents for prolonged shelf life. The lid is removed by simply lifting it from its interlocking engagement with the container and may be replaced by pressing it onto the container. While this type of lid is convenient for providing access to the container contents, it does not provide visual evidence when the lid has been removed and replaced and undetected tampering of the food contents may occur.

Various attempts have been made to provide a visual indication that the container lid has been removed. These arrangements generally provide a tear away member such as a tear ring or diaphragm which must be torn away before the container may be opened. Some of these devices, when used with disposable containers such as those in which cottage cheese, yogurt, ice cream and similar foods are packaged, may fail to securely couple the tear away member with the deformable container sidewall. The lid may be removed and replaced without detaching the tear away member by simply deforming the container sidewall to release that portion of the lid or tear away member which engages the sidewall. These devices may then present a serious safety hazard for consumers who, because of the presence of the intact tamper indicator, fail to inspect the container contents for signs of tampering.

SUMMARY OF THE INVENTION

It is an object of this invention to provide a tamper evident container for the packaging of food and other products which prevents removal of the container closure without detaching a tamper indicator strip so that detachment of the strip provides visual evidence of container tampering.

It is also an object of this invention to provide a tamper evident container for the packaging of food and other products which includes detachable locking members on the container closure to securely engage portions of the container sidewall to prevent removal of the closure even if the sidewall is deformed.

It is a further object of this invention to provide a tamper evident container for the packaging of food and other products that includes a tamper indicator which after detachment from the container closure permits reuse of the closure.

To accomplish these and other related objects of the invention, a tamper evident package for food items is provided which comprises a closure having a lid with a detachable tear strip on a peripheral edge of the lid for providing visual evidence of removal of the closure. The strip includes at least one locking member which presents an upwardly open channel for receiving a downturned lip of a container sidewall to lock the closure to the container. The locking member prevents removal of the closure without first detaching a portion of the tear strip from the peripheral edge of the lid.

The container of the package includes a sidewall which terminates in an upper rim. A lip extends from the upper rim and is spaced from the container sidewall for placement within the channel formed by the locking member of the closure. A circumferentially extending groove in the container sidewall engages a complementally sized and shaped rib on the closure to releasably secure the closure to the container to permit reuse of the closure after removal of the detachable strip.

BRIEF DESCRIPTION OF THE DRAWINGS

In the accompanying drawings in which like reference numerals are used to indicate like parts in the various views.

DESCRIPTION OF THE PREFERRED EMBODIMENT

Figure 1:
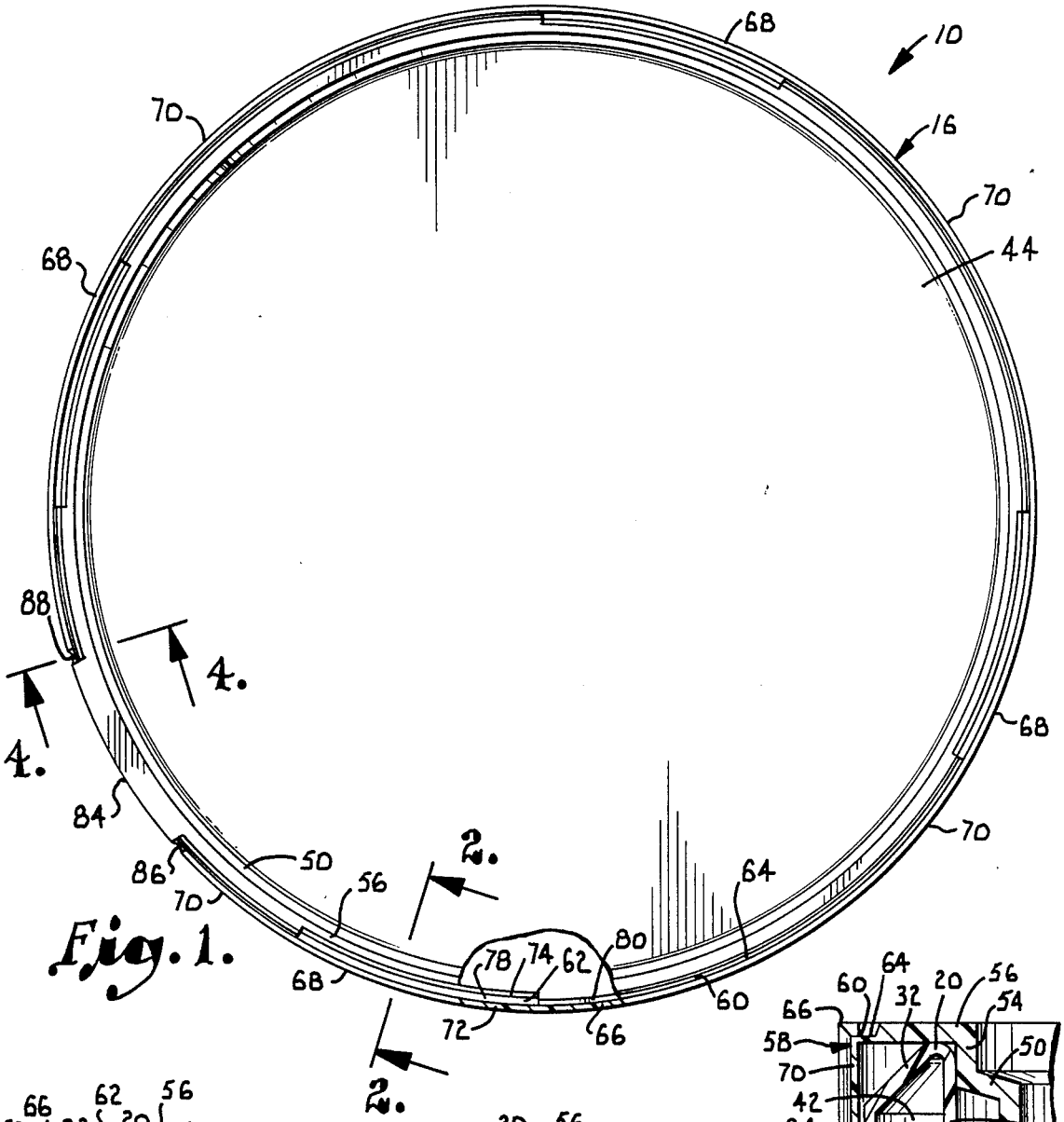
FIG. 1 is a top plan view of a tamper evident closure of the present invention with a portion broken away to illustrate the construction of the closure.

Referring now to the drawings in greater detail, a tamper-evident package suitable for containing cottage cheese, sour cream, yogurt and other similar products is represented generally by the numeral 10. Package 10 comprises a generally cylindrical container 12 having a bottom closure (not shown) and a removable top closure 16. Container 12 is preferably formed from injection molded plastic or coated paperboard but other suitable materials may also be utilized.

As best seen in FIGS. 2–5, container 12 has a sidewall 18 which terminates in an outwardly rolled upper rim 20. Sidewall 18 includes a circumferentially extending groove 22 formed on an inner surface 24 of the sidewall. The groove is preferably of an arcuate cross-section but other configurations may also be utilized. The upper portion of sidewall 18 has a stepped configuration with an outwardly extending shoulder section 26 separating the upper sidewall into a vertical lower section 28 and a vertical upper section 30.

The upper rim 20 of the container sidewall is rolled outwardly and includes a lip 32 which extends generally outwardly and downwardly and terminates in a vertical section 34. Vertical section 34 of the lip includes an outwardly extending flange 36 and has an inner surface 38 which is spaced outwardly from an outer surface 40 of the container sidewall upper section 30 to present a receiving channel 42 which receives a portion of the top closure 16.

Top closure 16 is preferably formed from thermoplastic material such as polyethylene, polypropylene, and polystyrene but other materials may also be utilized. Closure 16 includes a discoidal lid 44 which is sized for covering the open top of container 12. The peripheral edge of lid 44 includes a generally vertical wall 46. A circumferentially arcuate rib 48 is included in wall 46 and is sized and shaped for complemental engagement with groove 22 in the container sidewall. Vertical wall 46 has a stepped configuration and includes an outwardly extending shoulder section 50 which separates the wall into a vertical lower section 52 and a vertical upper section 54.

A flange 56 extends outwardly from a top edge of wall upper section 54 and overlies the outwardly rolled container rim 20. The outer edge of the flange is preferably vertically aligned with the outermost portion of the rim 20.

The peripheral edge of flange 56 includes a circumferentially extending skirt 58 which is spaced from wall 46 by the flange. A weakened line of detachment or tear line 60 is provided in flange 56 and comprises a plurality of spaced apart slits or cuts 62 and interconnecting frangible webs 64. The skirt 58 and that portion of flange 56 lying outwardly from tear line 60 comprise a detachable tear strip 66.

Figure 2:
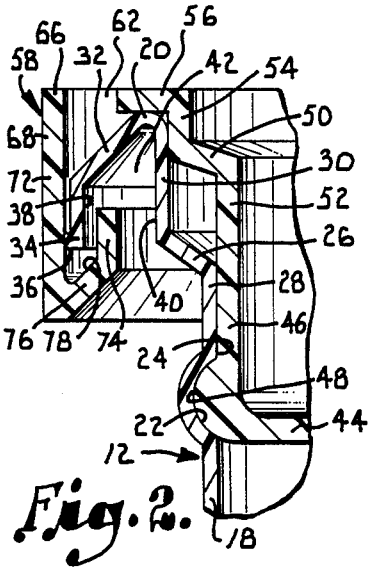
FIG. 2 is a fragmentary, vertical cross-sectional view taken along line 2—2 of FIG. 1 and showing on an enlarged scale the closure coupled to a container with a locking member engaging a portion of the container.

Skirt 58 includes a plurality of spaced apart locking members 68 and interconnecting wall members 70. Each locking member 68 is circumferentially positioned in alignment with cuts 62 so that the locking member is spaced from the inwardly adjacent flange 56 by a cut 62. As best seen in FIG. 2, each locking member 68 includes an outer vertical wall 72 and a spaced inner vertical wall 74 which is connected by an angular shoulder section 76 to the lower end of outer wall 72. The locking member thus presents an upwardly open channel 78 sized for receiving the lip vertical section 34 of the container sidewall 18.

The wall members 70 which interconnect locking members 68 to form continuous skirt 58 include a shoulder 80 formed on a lower inner surface 82 of each member. The shoulders 80 are positioned for engaging the bottom surface of the container lip flange 36.

A tab 84 is positioned on the skirt between two selected wall members 70 and includes vertical score lines 86 and 88 which allow the tab to be lifted upwardly and separated from the wall 80 of members 70.

In use, the cottage cheese, yogurt, ice cream or other product which is to be packaged is inserted into the container 12. The top closure 16 is then applied to seal the contents. The closure and container are configured such that rib 48 at the periphery of closure 16 is received within groove 22 formed in the inner sidewall 18 of container 12. Engagement of closure wall sections 52 and 54 with container wall sections 28 and 30, respectively, in cooperation with rib 48 and groove 22 provide an effective seal to prolong the shelf life of the food contents. Contact between the lower surface of flange 56 with container upper rib 20 also contributes to the seal.

When closure 16 is initially applied to container 12, the bottom portion of the locking member is folded upwardly by a heated head or similar device to form inner wall 74. Extension of inner wall 74 into the receiving channel 42 and extension of container lip 32 within locking member channel 78 cooperate to prevent removal of the closure from the container while the locking members are in place. Even if the container sidewall 18 should be deformed in an attempt to remove the closure, the locking engagement of locking members 68 with container lip 32 prevents removal of the closure. The inner shoulders 82 of the skirt wall members 70 also engage the lower edge of the container lip to prevent vertical displacement of the closure which would break the sealing contact between the closure and container.

To effect removal of closure 16 from container 12, the tab 84 which provides a finger grip is lifted upwardly and detached on one end along either score line 86 or 88. The tab may then be pulled outwardly to completely detach tear strip 66 along tear line 60 by breaking frangible webs 64. Cuts 62 along the tear line facilitate removal of tear strip 66 at the location of locking members 68 as the locking engagement between locking members 68 and lip 32 might otherwise impede removal of the strip.

Figure 3:
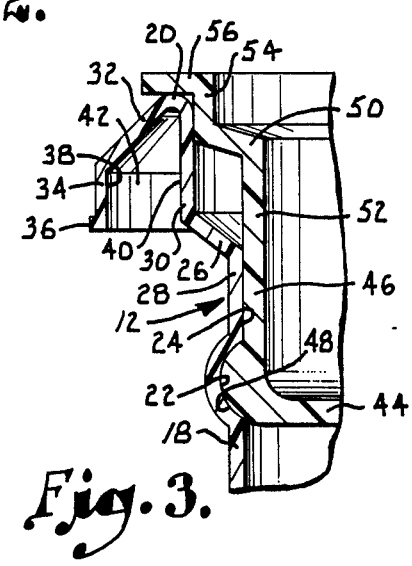
FIG. 3 is a fragmentary cross-sectional view similar to that shown in FIG. 2 but with a detachable tear strip removed.
Figure 4:
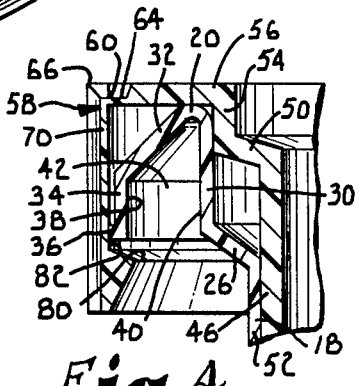
FIG. 4 is a fragmentary, vertical cross-sectional view taken along line 4—4 of FIG. 1 and showing on an enlarged scale another portion of the detachable tear strip coupled with the container.
Figure 5:
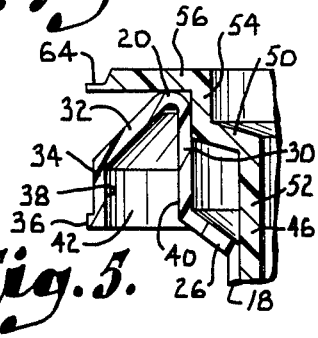
FIG. 5 is a fragmentary cross-sectional view similar to that shown in FIG. 4 but with the detachable tear strip removed.

After the strip 66 has been detached, top closure 16 may be removed from the container. As can be seen in FIG. 5, convenient finger grips on the closure 16 are provided by the outwardly extending flange 56 portions which remain after removal of tear strip 66. Finger access is provided at those portions of the flange which were connected with wall members 70 of skirt 58. The downwardly sloping container lip 32 facilitates accessibility to the undersurface of those flange portions for easy removal of the closure. As shown in FIG. 3, those portions of the flange which were separated from the adjacent locking members 68 by cuts 62 are not coextensive with those flange portions previously connected to wall members 70. In addition to providing a better finger grip for removing closure 16, sloping container lip 32 also functions to direct contaminates away from the contents of the container.

It can thus be seen that locking members 68 provide an effective method for preventing removal of closure 16 even upon deformation of the container sidewall 18. Before the closure can be removed, tear strip 66 which includes locking members 68 must be at least partially detached from the closure. The tear strip thus provides a visual indication that unauthorized opening of the container has taken place if the strip is partially or totally detached. Once the tear strip has been removed, the closure may be easily gripped for removable and subsequent replacement.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A tamper evident closure for a container having a sidewall terminating in an upper rim which has a downturned lip spaced outwardly from the container sidewall to present an open bottom channel between the lip and sidewall, said closure comprising:

a lid sized for covering an open top of the container when coupled therewith and having a peripheral edge;

means on said peripheral edge of the lid for releasably holding the lid on the container;

a detachable strip extending circumferentially around said peripheral edge of the lid and including a plurality of circumferentially spaced locking members and wall means extending between adjacent locking members, each locking member including a downwardly projecting skirt and a wall connected with said skirt and cooperating therewith to present an open top channel in which said lip of the rim is disposed when the lid is applied to the container, with said wall extending into said open bottom channel to effect interlocking between said open top channel and said open bottom channel to prevent release of the closure from the container unless said strip is at least partially detached from the lid; and means carried on said wall means for engaging said lip between said locking members in a manner to hold the closure in sealing engagement with the container.

2. The closure of claim 1, wherein said strip is detachable from said lid along a weakened detachment line.

3. The closure of claim 2, wherein said detachment line includes a plurality of circumferentially spaced cuts separated at their adjacent ends by frangible webs.

4. The closure of claim 2, including a tab on said strip to provide a finger grip on said strip for removal thereof.

5. The closure of claim 1, wherein said releasable holding means on said peripheral edge includes a peripheral rib for releasable engagement with a complimentally sized and shaped groove formed in the container sidewall.

6. The closure of claim 2, including an outwardly projecting flange at the peripheral edge of said lid coupled with said skirt, wherein said flange includes said weakened detachment line and wherein said detachable strip comprises said skirt and the portion of said flange located on one side of said detachment line.

7. The closure of claim 6, including a plurality of circumferentially spaced cuts in said flange, each cut separated from an adjacent cut by a frangible web with said detachment line extending through said frangible web.

8. A tamper evident closure for a container having a sidewall terminating in an upper rim which includes a downwardly projecting lip spaced from said container sidewall to present an open bottom channel, said closure comprising:

a discoidal lid sized for covering an open top of the container when coupled therewith and having a peripheral edge;

a lid sidewall extending above said lid at said peripheral edge and releasably engageable with the container sidewall; and a detachable strip extending circumferentially around said peripheral edge of the lid and including a plurality of circumferentially spaced locking members and wall means extending between adjacent locking members, each locking member including a downwardly projecting skirt and a wall connected with said skirt and cooperating therewith to present an open top channel in which said lip of the rim is disposed when the lid is applied to the container, with said wall extending into said open bottom channel to effect interlocking between said open top channel and said open bottom channel to prevent release of the closure from the container unless said strip is at least partially detached from the lid.

9. The closure of claim 8, wherein said strip is detachable from said lid sidewall along a weakened detachment line.

10. The closure of claim 9, wherein said detachment line includes a plurality of circumferentially spaced cuts separated at their adjacent ends by frangible webs.

11. The closure of claim 9, including a tab on said strip to provide a finger grip on said strip for removal thereof.

12. The closure of claim 8, wherein said lid sidewall includes a peripheral rib for releasable engagement with a complimentally sized and shaped groove formed in the container sidewall.

13. The closure of claim 9, including an outwardly projecting flange at the upper edge of said lid sidewall coupled with said skirt, wherein said flange includes said weakened detachment line and wherein said detachable strip comprises said skirt and the portion of the flange located on one side of said detachment line.

14. The closure of claim 13, including a plurality of circumferentially spaced cuts in said flange, each cut separated from an adjacent cut by a frangible web with said detachment line extending through said frangible web.

15. A tamper evident package for food such as dairy products, said package comprising:

a container having a sidewall terminating in an upper rim, said sidewall having an inner surface with a circumferentially extending groove formed therein;

a lip extending outwardly and downwardly from said upper rim and spaced from said container sidewall to present an open bottom channel between said lip and said container sidewall;

a discoidal lid sized for covering an open top of the container and having a peripheral edge;

a lid sidewall extending above said lid at said peripheral edge and having an outer surface with a circumferentially extending rib formed thereon, said rib sized for complemental engagement with the groove formed in the container sidewall;

a detachable strip at an upper edge of said lid sidewall and generally overlying the upper rim of the container sidewall, said detachable strip including at least one locking member spaced from the lid sidewall and including a downwardly extending skirt and a wall connected with the skirt and cooperating therewith to present an upwardly open channel into which said lip extends, said wall of the locking member extending upwardly into said open bottom channel;

whereby said open bottom channel and said upwardly open channel interlock to prevent release of the closure from the container when coupled therewith without at least partial detachment of said strip from the lid.

16. The closure of claim 15, wherein said strip is detachable from said lid sidewall along a weakened detachment line.

17. The closure of claim 15, wherein said detachment line includes a plurality of circumferentially spaced cuts separated at their adjacent ends by frangible webs.

18. The closure of claim 17, including a plurality of circumferentially spaced locking members.

19. The closure of claim 16, including a tab on said strip to provide a finger grip on said strip for removal thereof.

20. The closure of claim 16, including an outwardly projecting flange at the upper edge of said lid sidewall coupled with said skirt, wherein said flange includes said weakened detachment line and wherein said detachable strip comprises said skirt and the portion of said flange located on one side of said detachment line.

21. The closure of claim 20, including a plurality of circumferentially spaced cuts in said flange, each cut separated from an adjacent cut by a frangible web with said detachment line extending through said frangible web.

22. The closure of claim 21, wherein said skirt includes a plurality of circumferentially spaced locking members and a tab portion positioned between two adjacently positioned locking members to provide a finger grip for removal of the detachable strip.

* * * * *